United States Patent [19]

Fujita

[11] 4,301,729

[45] Nov. 24, 1981

[54] MANUALLY-OPERATED LABELER

[75] Inventor: Mituo Fujita, Sakatoshi, Japan

[73] Assignee: Kabushiki Kaisha Shinsei Industries, Tokyo, Japan

[21] Appl. No.: 161,912

[22] Filed: Jun. 23, 1980

Related U.S. Application Data

[63] Continuation of Ser. No. 942,380, Sep. 14, 1978, abandoned.

[30] Foreign Application Priority Data

| | | | |
|---|---|---|---|
| Sep. 19, 1977 | [JP] | Japan | 52/111607 |
| Nov. 9, 1977 | [JP] | Japan | 52/135122 |
| May 24, 1978 | [JP] | Japan | 53/69932[U] |

[51] Int. Cl.[3] ..... B65C 11/02

[52] U.S. Cl. ..... 101/291; 101/305; 101/348; 156/384; 156/541; 156/577; 156/579; 156/584; 156/DIG. 49

[58] Field of Search ..... 156/384, 541, 577, 579, 156/584, DIG. 48–49; 101/287, 288, 291, 292, 293, 295, 327, 329, 348, 316, 320, 406

[56] References Cited

U.S. PATENT DOCUMENTS

| | | | |
|---|---|---|---|
| 2,887,043 | 5/1959 | Terry | 101/406 |
| 3,063,364 | 11/1962 | Kahlen | 101/406 |
| 3,705,833 | 12/1972 | Wada | 156/384 |
| 3,759,178 | 9/1973 | Franchinot et al. | 101/348 |
| 3,800,701 | 4/1974 | Martin | 101/288 |
| 3,814,651 | 6/1974 | Wada | 156/541 |
| 3,902,412 | 9/1975 | Pabodie | 101/288 |
| 3,934,507 | 1/1976 | Geri | 156/384 |
| 3,968,745 | 7/1976 | Hamisch, Jr. | 156/384 |
| 4,044,677 | 8/1977 | Hamisch, Jr. | 101/348 |
| 4,125,420 | 11/1978 | Hamisch, Jr. | 156/584 |
| 4,153,495 | 5/1979 | Hamisch, Jr. | 156/384 |
| 4,156,627 | 5/1979 | Hamisch, Jr. | 156/384 |

*Primary Examiner*—Michael G. Wityshyn
*Attorney, Agent, or Firm*—Wenderoth, Lind & Ponack

[57] ABSTRACT

A labeler for dispensing labels from a carrier strip having labels stuck onto the strip. The labeler has a case in which is a carrier strip feeding mechanism driven by an actuating mechanism for advancing the carrier strip so as to turn it around a turnback member for separating the label from the carrier strip. A printing apparatus is provided which moves toward the turnback member for printing a label which is passing thereover on the carrier strip. The printing apparatus is mounted on the operating part of the actuating mechanism so that it can rock in a direction transverse to its plane of movement so that it can adjust to the level of the turnback member. The labeler also has a guide member for guiding the carrier strip over a feed drum which can be pivoted out of the way to thread a carrier strip into the labeler. An ink applying device is provided having a resilient guide engaged with the ink applying roller so that it can be moved out of the way to remove the roller. The case can be provided with a door, the hinge means of which provides a spring force tending to urge the door in the opening direction when the door is closed, and resiliently mounting the door hinge for rotation around a shaft in the casing. A slide member is provided adjacent the turnback member to support the rear edge of the label as it is separated from the carrier strip.

14 Claims, 14 Drawing Figures

10
11
111
12
13
20
21
22
22a
22'
221
222
223
30
31
32
33
34
35
36
37
40
41
42
50
51
52
521
53
60
61
70
71
72
73
112

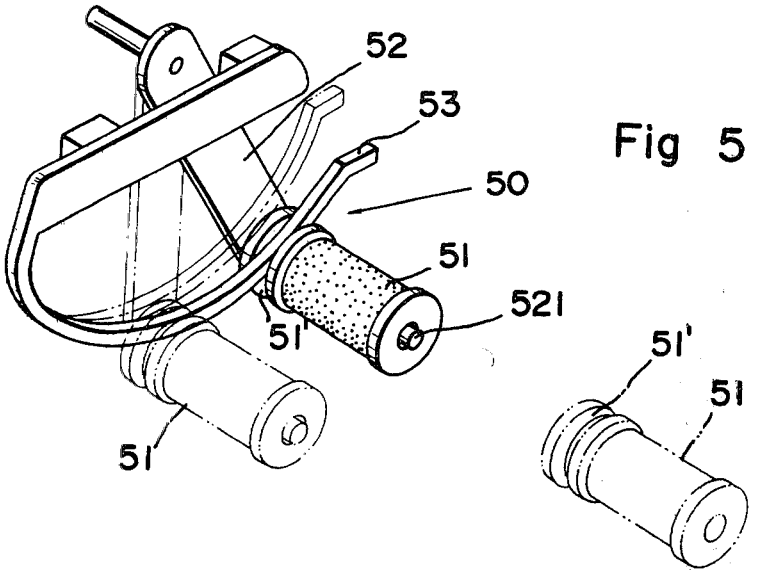
Fig 5
Fig 7
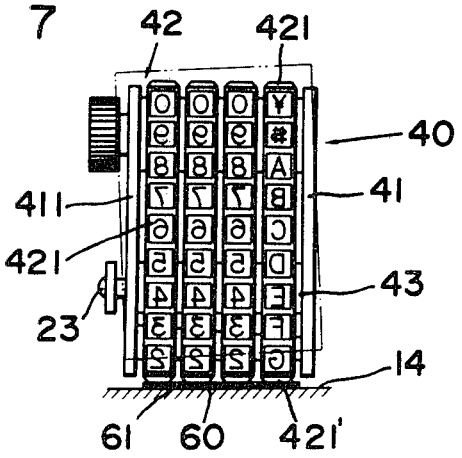

72
73
73
71

72
73
73

72
73

MANUALLY-OPERATED LABELER

This application is a continuation of application Ser. No. 742,380, filed Sept. 14, 1978, now abandoned.

BACKGROUND OF THE INVENTION

The present invention relates to a manually-operated labeler which is adapted to turn a label carrying carrier strip at a carrier strip turnback part of reciprocating movement of a hand lever and to separate labels one by one from the carrier strip.

This type of conventional labeler has disadvantages since the printing apparatus which prints numerals and symbols is held between the forked operating ends of the lever.

The construction of the lever is complicated and therefore the space in the labeler is not effectively utilized. Assembly of the labeler is difficult since it is necessary that the printing face of the printing apparatus be parallel to the label receiving surface opposite to the printing face. If the case is a side-opening type case, the carrier strip cannot be set from the side because the operating part of the lever hinders the setting.

An object of the present invention is to provide a labeler in which only one side of the printing apparatus is supported by the operating part so that there is no operating part of the lever in the opening even when the case is opened from the other side.

Another object of the present invention is to provide a labeler in which the printing apparatus is coupled to the operating part of the lever so as to be movable and the printing face of the printing apparatus comes in close contact with a label without being inclined.

Another object of the present invention is to provide a labeler in which the space in the case is effectively utilized owing to the non-forked construction of the operating part of the lever.

SUMMARY

The present invention provides a manually-operated labeler which has a case incorporating a printing apparatus and a carrier strip feeding means which are constructed so that a carrier strip onto which labels are attached is turned back at a carrier strip turnback part and forced to intermittently advance a specified distance to separate a label from the carrier strip at the carrier strip turnback part and the surface of said label is printed by a printing apparatus at a position ahead of the carrier strip turnback part, and impression and separation of said printing apparatus onto and from a label are carried out by a swinging operation of the lever. The printing apparatus comprises a holding frame on which is supported at one side the operating part of said lever, a printing mechanism which is provided in the holding frame and a coupling part which is provided on the frame plate at the lever mounted side of said holding frame, said coupling part having a cylindrical member which projects parallel to the printing face of said printing mechanism and an engaging part provided in said cylindrical member, said engaging part being formed by extending the central part of the inner wall of said cylindrical member toward the center, said lever having the swinging end at the fixing part of the holding frame and a fixing shaft, which is to be inserted into the cylindrical member, provided at said fixing part, said fixing shaft being seized by said seizing part so that both sides of an array of types on said printing face swing to vary their positions around the seizing part as a fulcrum, and said case being provided with an opening through which the carrier strip is set in the case, at a side where there is no operating part of the lever.

BRIEF DESCRIPTION OF THE DRAWINGS

The present invention is illustrated in detail by the accompanying drawings in which:

FIG. 5 is a perspective view of the ink applying device of the labeler, FIG. 7 is a front view of the printing apparatus during a printing operation.

DETAILED DESCRIPTION OF THE INVENTION

Figure 1:
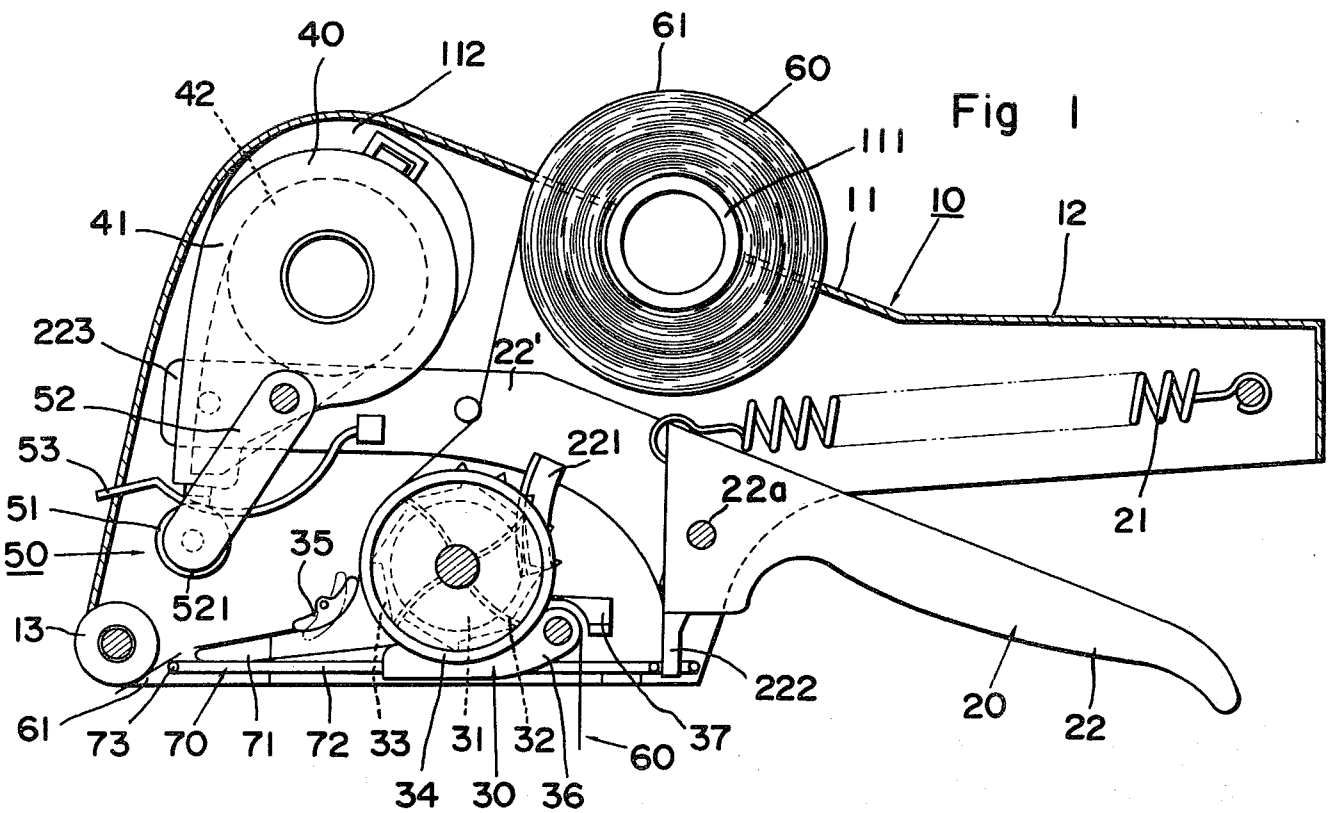
FIG. 1 is a cross sectional side elevation view showing the interior of the labeler in accordance with the present invention.
Figure 4:
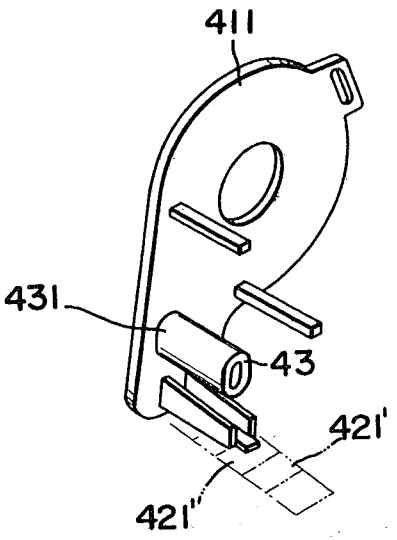
FIG. 4 is a perspective view showing the coupling side frame plate of the printing apparatus of the labeler.

In FIG. 1, case 10 has a main frame 11 and a handle 12 and the main frame 11 is provided with a carrier strip holder 111, about chamber 112 and a pressing roller 13 at the lower forward end.

Said case 10 is provided with an actuating mechanism 20, which is always urged away from the handle 12 of the case 10 by a reset spring 21 and has a lever 22 pivotally secured on shaft **22*a* on the main frame 11 and this lever 22 is provided with a first actuating means, for example, rack gear 221 which is provided on the operating part 22' of the lever 22 within said case 10 to actuate carrier strip feeding mechanism 30 during the swinging operation of the lever and a second actuating means, for example, engaging projection 222 which actuates a label separating mechanism 70 described later during the swinging operation of the lever. The free end of the operating part 22' is provided with a mounting part 223 on which a printing apparatus 40** is mounted.

Said carrier strip feeding mechanism 30 comprises a gear 31 which engages with the rack gear 221 on said lever 22, resilient rotary claws 32 which are provided on gear 31 and which radially project from the center thereof, a one-way clutch 33 provided with claw teeth which internally engage with corresponding rotary claws 32 and which is held on the internal way by rotation of said rotary claw 32 in a one direction, tape feed drum 34 which is connected to and rotates with the clutch 33, guide member 35 and depressing swing member 36 which operate to press the carrier strip 60 onto drum 34, and stripper 37.

The operation of said one-way clutch 33 is in accordance with the swinging direction of lever 22. Generally, clutch 33 idles during swinging of lever 22 toward handle 12and then operates to rotate feed drum 34 during movement of lever 22 away from handle 12.

Said guide member 35 is pivotally mounted at its center on case 10 so that its two ends seesaw and, in the figure, the upper end is moved toward drum 34 by clockwise rotation in the figure.

In this construction, the upper end of guide member 35 is moved away from drum 34 by pivoting the guide member 35 to the position shown by the broken line so that carrier strip 60 with labels 61 thereon can be inserted laterally between the guide member and the drum 34, and the lower end of the guide member can then be automatically pushed up by pulling carrier strip 60 in the feed direction so as to urge the upper end of the guide member toward the drum 34, whereby the carrier strip 60 with labels 61 thereon will be pressed against the drum 34.

Said carrier strip 60 on which labels 61 are adhered in succession is wound in the form of a roll and mounted on said carrier strip holder 111, and each label 61 is separated from carrier strip 60 and advanced by turning carrier strip 60 around carrier strip turnback part 71 of the separating mechanism and continuing the advance of the carrier strip 60.

Said printing apparatus 40 is mounted on the part 223 of said lever 22 and is provided with a holding frame 41 which rises and falls as lever 22 swings, and a printing mechanism 42 is provided in this holding frame 41. The side frame plate 411 which forms the part of the holding frame 41 toward the operating part 22' of lever 22 has a mounting member 43 thereon by which the printing mechanism is mounted on lever 22.

Figure 2:
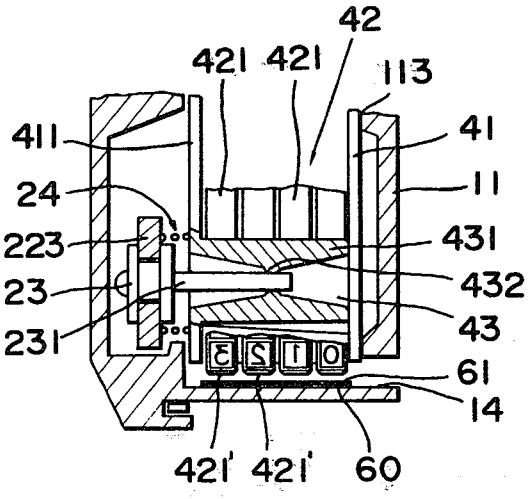
FIG. 2 is a cross sectional front view on an enlarged scale of the principal part of the printing apparatus of the labeler according to the invention.

Printing mechanism 42 provided in said holding frame 41 has the required number of type belts 421 which are arranged in parallel so that the printing faces of the printing mechanism, namely, the print types 421' positioned at the lower end as shown in FIG. 2 can be varied, in the same manner as in the conventional mechanism.

Said mounting member 43 has a hollow cylindrical member 431 extending parallel to the printing face, from frame plate 411 and a gripping fulcrum 432 is provided in this cylindrical member formed by, for example, reducing the diameter of the inside wall of cylindrical member 431.

Mounting part 223 of said lever 22 and the holding frame 41 are coupled by a securing shaft, for example, pin 23 which is inserted into cylindrical member 431 through a hole in mounting part 223, as shown in FIG. 2, and the inserted shaft part 231 of this pin 23 is gripped by said gripping fulcrum 432 in said cylindrical member 431, and a spring 24 is provided between frame plate 411 and mounting part 223.

Figure 3:
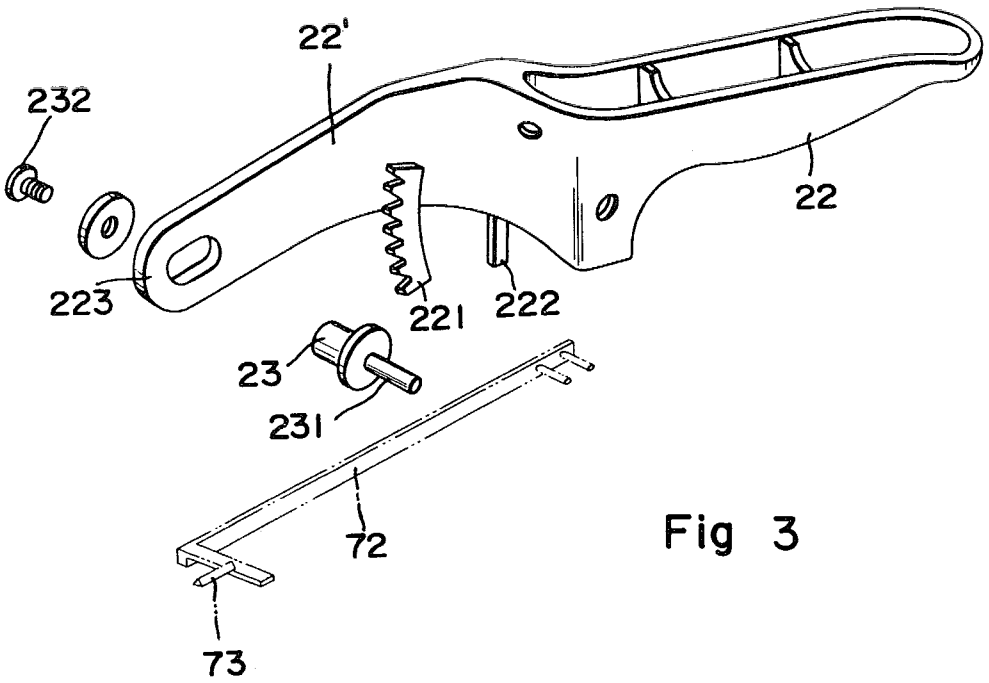
FIG. 3 is an exploded perspective view of the lever of the labeler and certain related parts.

In the embodiment, in addition to the above-described construction, a guide means which guides holding frame 41, for example, guide wall 113 formed on the inside wall of main frame 11, is provided and said pin 23 is constructed so that flanged shaft 231 is fixed to lever 22 by a screw 232 as shown in FIG. 3. Accordingly, printing apparatus 40 is supported on pin 23 so that both the right and left sides in FIG. 2, that is, both sides of the type arrangement can be slightly swung around gripping fulcrum 432 as a fulcrum. Ink applying device 50 is provided in a position opposed to said printing apparatus 40. This ink applying device 50 has a swing lever 52 which is pivotally secured at one end on the inside wall of the case 10, and is provided with an ink roller 51 on the other end and swing lever 52 is tensioned by a spring, which is not shown in the figure, so that ink roller 51 is always urged into contact with print types 421' of the printing apparatus 40, and swing lever 52 is swung by the force of the printing apparatus on which the ink roller bears when said printing device 4 is lowered.

Moreover, as shown in FIG. 5, said ink roller 51 is demountably positioned on support shaft 521 of swing lever 52 and retained by resilient engaging guide member 53 so that it does not come off by engagement of guide member 53 in engaging groove 51' and guide member 53 is shaped in a circular shape to guide ink roller 51 during its reciprocating movement. In this construction, ink roller 51 can be removed from support shaft 521 by urging guide member 53 upwardly to the phantom line position to disengage it from groove 51'.

Said label separating mechanism 70 has carrier strip turnback part 71 for turning back the carrier strip 60 to separate therefrom a label 61 which has been printed by printing apparatus 40 from carrier strip 60, slide member 72 which is slidably mounted just below the carrier strip turnback part 71, the slide member being caused to slide by the second actuating means of said lever 22 that is, engaging projection 222. The slide has at least one supporting projection 73 which is provided to hold the rear end of a label 61 separated from carrier strip 60 at the extreme end of slide member 72. The slide member 72 is retracted when label 61 begins to advance, and starts moving forward when label 61 protrudes from strip 60 by a predetermined amount, for example, its length, and partly supports the rear part of label 61 on supporting projection 73 as shown in FIG. 1 when label 61 is completely forwarded.

Figures 6A, 6B, 6C:
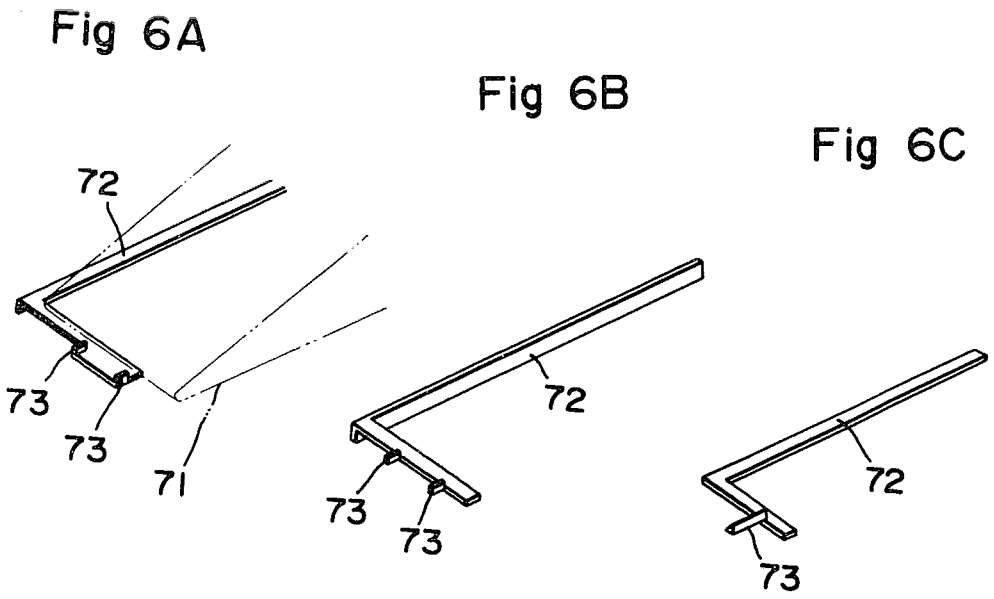
FIGS. 6A, 6B and 6C are respectively perspective views of an embodiment of the side member of the labeler.

Said supporting projection 73 or projections 73 support a label by spot contact or linear contact as shown in FIGS. 6A to 6C and are covered with an adhesion inhibiting agent such as silicone if necessary.

If label 61 is supported at its rear end by supporting projection 73, it is possible to eliminate the disadvantage that the carrier strip 60 is pulled away from the turnback part by a label 61 when the label 61 is stuck onto an article.

In other words, the conventional labeler of this type is constructed so that a label partly separated from the carrier strip and protruding from the labeler is held by the carrier strip in a position with the rear end of the label stuck to the carrier strip. Therefore slackness of the carrier strip cannot be avoided due to the fact that tension is applied to the label during sliding of the label when the label is stuck to an article and the labeler is moved away from the article. In such an arrangement the carrier strip is pulled in the label forwarding direction away from the carrier strip turnback part and accordingly the label feed distance differs at each operation of the labeler due to such slackness of the carrier strip and incorrect registration of the printing is caused. By the construction of the present embodiment these disadvantages can be eliminated.

The labeler as described above operates as follows. When lever 22 is forced to approach handle 12, slide member 72 retracts, printing apparatus 40 approaches carrier strip 60, ink roller 51 rubs the type face and moves out of the path of the downwardly moving printing apparatus 40 and finally the printing apparatus 40 comes in contact with label 61 on the surface 14 of carrier strip 60.

When lever 22 is released and reset by reset spring 21, rack gear 221 operating as the first actuating means drives one-way clutch 33 and feed drum 34 which are coupled and feed drum 34 forwards carrier strip 60 by the desired amount while printing apparatus 40 rises to its initial raised position and simultaneously ink applying device 50 is also reset.

Carrier strip 60 is turned back at carrier strip turnback part 71, and label 61 on the carrier strip is peeled off and forwarded to impression roller 13 and slide member 71 advances to support label 61 as label 61 is forwarded.

In the above operation, printing apparatus 40 is supported at one side only on the operating 22' of the lever 22 on pin 23 so that the position thereof in the direction of the alignment of the type elements 421' can be varied, as shown by the broken line in FIG. 7, so that when the printing face has reached the lowest position it can make close contact with the surface 14 and uniform printing on label 61 can be carried out even though the printing faces of the type elements when they are at the highest position and the surface 14 which supports carrier strip 60 are not perfectly parallel.

Since the labeler according to the present invention is constructed as described above, the following effects can be expected when it is used.

Lever 22 need not be a fork type lever and the construction of the actuating mechanism can be simplified.

Since relative inclination of the printing face and the surface 14 and the inclination of the printing apparatus 40 caused during raising and lowering can be compensated for by displacement of printing apparatus 40 around gripping fulcrum 432, print types 421 which form the printing face are surely forced to contact label 61 to carry out clear printing.

Accordingly, the labeler of the present invention provides good effects for this type of labeler.

Since the printing apparatus is supported only at its one side on the lever and the part of the side of case 10 where there is no operating part 22' of lever 22 is opened and closed, carrier strip 60 can be loaded in the apparatus without being obstructed by operating part 22' of lever 22 as shown in FIG. 1.

The following describes another embodiment of the present invention as shown in FIGS. 8 to 12. This embodiment is of the labeler with a modified opening in case 10 and can provide larger impact strength.

The door of a side-opening type labeler has often been subject to shock due to dropping during loading the carrier strip or being struck by other articles and therefore the hinge of the door has been deformed and the door cannot be smoothly operated. This embodiment provides a manually-operated labeler capable of absorbing such external shock.

Figure 8:
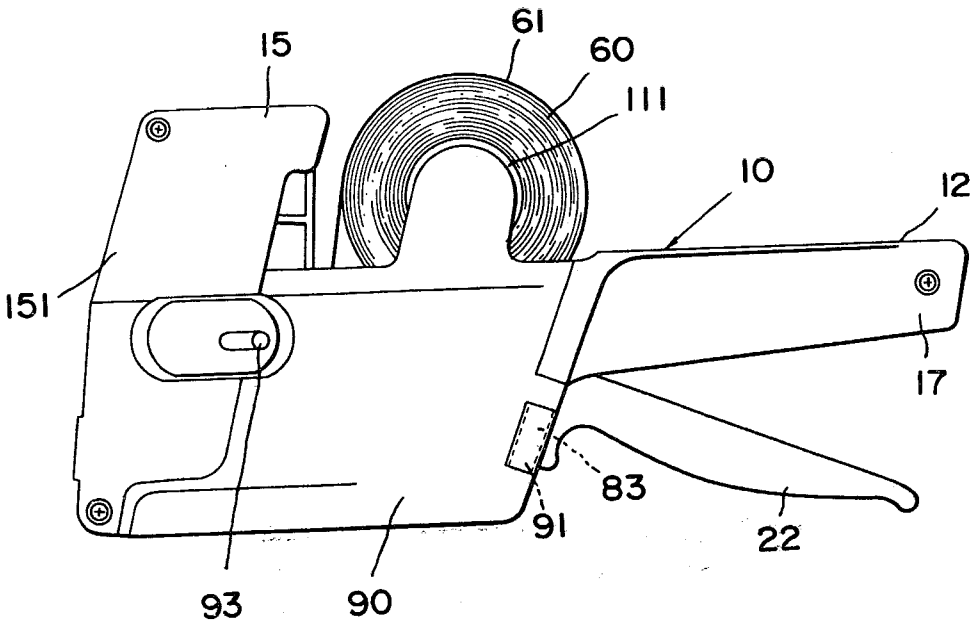
FIG. 8 is a side view showing another embodiment of the labeler.

FIG. 8 shows the labeler when its door is closed. In the figure, case 10 is formed so that its one side is entirely open and it is provided with a carrier strip holder 111 at its center, a handle 12 adjacent to the carrier strip holder, a front chamber 15 containing the printing apparatus 40 connected to the carrier strip holder and a central chamber 16 containing the carrier strip feeding mechanism 30 below carrier strip holder 111.

Figure 9:
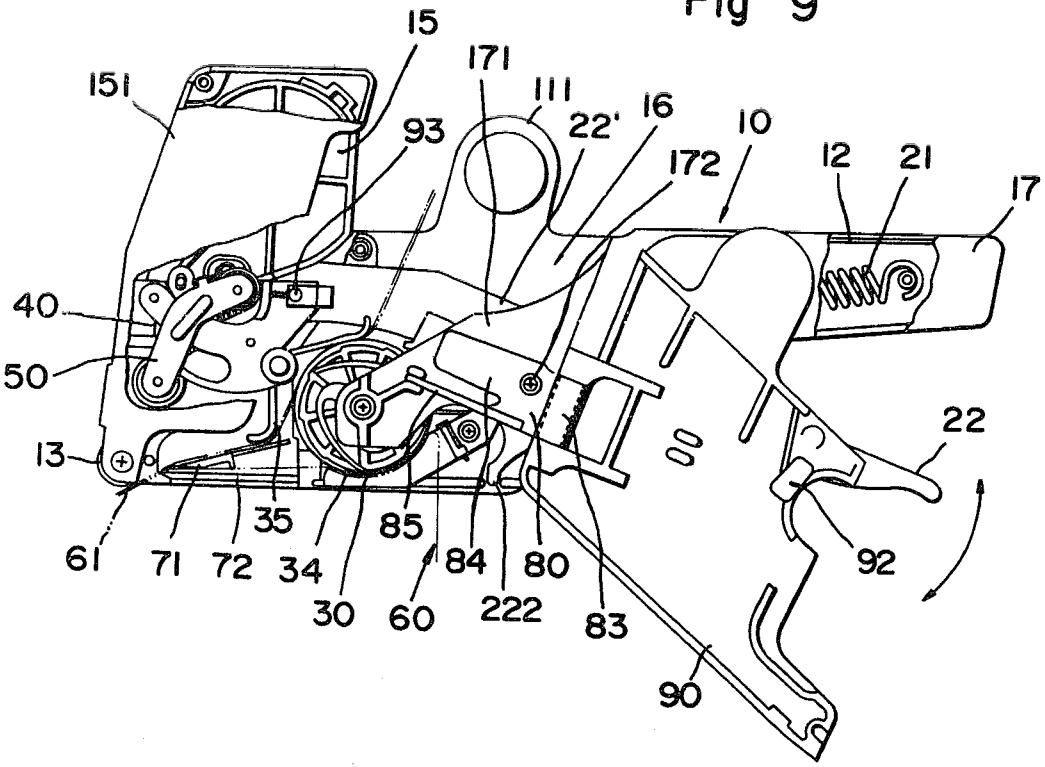
FIG. 9 is a partly cutaway side view of the labeler shown in FIG. 8 with the case opened.
Figure 10:
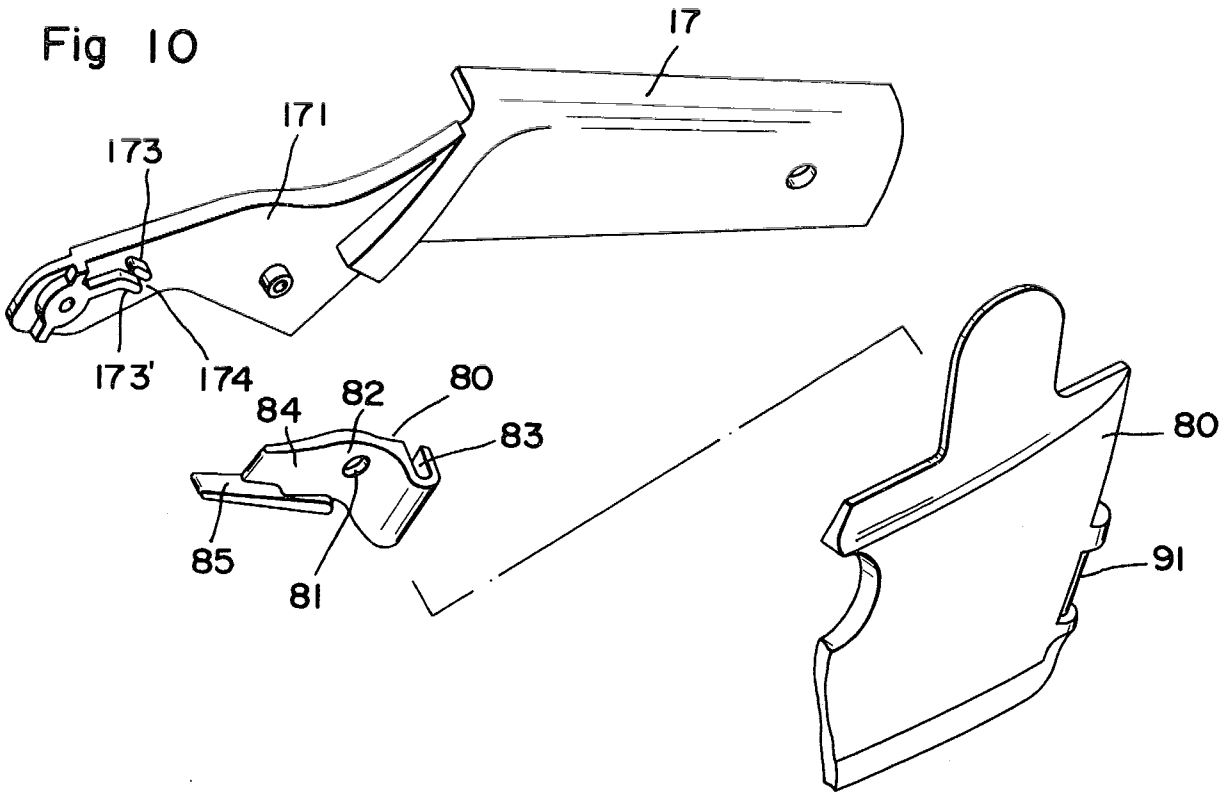
FIG. 10 is an exploded perspective view of the handle cover, hinge and opening door of the labeler shown in FIG. 9.

Handle 12 of said case 10 has a handle cover 17 as shown in FIGS. 9 and 10 and said handle cover 17 is provided with projecting member 171 extended into the central chamber 16.

Carrier strip feeding mechanism 30 and actuating lever 22 are pivotally secured to said projecting member 171 and an engaging claw which is not shown in the figures is provided on the body of actuating lever 22 whereby carrier strip feeding mechanism 30 is actuated as in the embodiment of FIGS. 1–7 so that carrier strip 60 is fed only when actuating lever 22 is returned to its initial position after being pivoted toward handle 12.

Support shaft 172 which pivotally supports lever 22 has mounted therein a hinge means 80 on which cover 90 for opening and closing central chamber 16 is hinged. Said hinge means 80 comprises, as shown in FIGS. 9 and 10, body 82 provided with a shaft hole 81 into which said support shaft 172 is inserted, a coupling means formed on an end of body 82 such as, for example, shaft engaging groove 83 with a U-shaped horizontal cross section and a vertical lug 84 and a horizontal lug 85 provided at the opposite end of said body 82 from shaft engaging groove 83. Said vertical lug 84 is a resilient member which has a spring effect in the door opening and closing direction and is displaced by the internal surface of the door when door 90 is closed to urge the door outwardly, and said horizontal lug 85 is a resilient member which can be bent independently of said vertical lug 84 and is arranged to resiliently oppose movement of said shaft engaging groove 83 around support shaft 172 as a center. The extreme end of said horizontal lug 85 is secured to the end of projecting member 171 of handle cover 17 so that the end of the lug 85 is held as the hinge body is rotated in either direction.

For this purpose, two projections 173 and 173' are provided on the internal end surface of said projecting member 171 and the extreme end of said horizontal lug 85 is inserted into the space 174 between these two projections 173 and 173'.

Said door 90 is provided with a coupling part on the edge thereof for shaft 91 which is fitted into said shaft engaging groove 83 for pivotally securing said hinge 80 with the coupling part, and a locking means such as, for example, engaging part 92 is provided at the other end of the door to hold the door closed.

The front chamber 15 of said case 10 is provided with cover 151 on which an operating means such as, for example, push button 93 which engages and disengages said engaging part 92 is provided.

Figure 11:
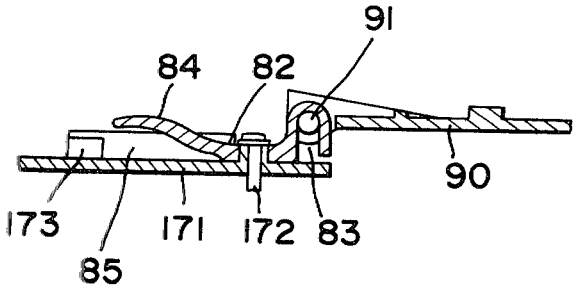
FIG. 11 is a sectional plan view showing the position of the hinge when the door shown in FIG. 9 is opened.
Figure 12:
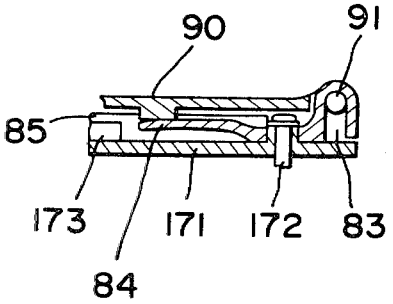
FIG. 12 is a sectional plan view showing the position of the hinge shown in FIG. 11 when the door is closed.

Since the labeler in accordance with this embodiment is constructed as described above, door 90 pushes vertical lug 84 which maintains the door in the closed position as shown in FIG. 12 when door 90 is closed and said engaging part 92 is locked by push button 93 and which causes the door to swing open as shown in FIG. 11 when engaging part 92 is released.

In this case, door 90 protrudes slightly due to the spring effect of vertical lug 84 as soon as engaging part 92 is released and therefore a trigger is not required.

When door 90 is opened, central chamber 16 is open so as to be visible and carrier strip 60 can be loaded onto the carrier strip holder 111 and an end of the carrier strip can be pulled out and set in the carrier strip feeding mechanism 30 and carrier strip turnback part 71.

If an external shock is inadvertently applied to door 90 when it is open, door 90 is moved in the direction of the arrow shown in FIG. 9 and hinge 80 absorbs displacement of door 90 by the resilience of horizontal lug 85 and door 90 returns to its initial position after the shock is ended; therefore subsequent opening and closing operations will not be hindered.

Instead of being supported on projecting member 171 hinge 80 can be engaged with another supporting means provided on the case, for example, it can be directly provided on the inside wall of the central chamber 16.

This embodiment of said labeler is a so-called substrate supported label type labeler. Furthermore the labeler can be a label hammering out type by which labels are hammered out from a window of the labeler by a hammering out member. In the latter case, said slide member 72 of the separating mechanism 70 is not required.

What is claimed is:

1. A labeler comprising:

a case having a carrier strip holder for holding a roll of carrier strip onto which a number of labels are stuck;

an actuating mechanism having an operating part extending into the case and pivotally mounted on said case and pivotable for movement within said case;

a carrier strip feeding mechanism housed in said case and having a feed drum engaging the carrier strip from the roll, said feed drum being driven by said operating part during movement thereof for feeding a fixed length of carrier strip when said carrier strip feeding mechanism is driven by said operating part;

a carrier strip turnback member in said case around the edge of which member the carrier strip is turned by the feeding action of said feeding mechanism for separating a label stuck on said carrier strip;

a guide member having a center portion pivotally mounted in said case along the path of the carrier strip between said feed drum and said turnback member and having the opposite ends normally engaging the carrier strip for guiding the carrier strip around part of the periphery of the feed drum, said guide member having one end adjacent said feed drum movable toward and away from said feed drum during the pivotal movement of said guide member to permit a carrier tape to be threaded around the drum when the labeler is being loaded with a carrier tape, said turnback member being positioned along the path of the carrier strip from said guide member for causing the other end of said guide member to be engaged by the tape normally extending from said drum to said turnback member to urge said one end of said guide member toward said drum; and a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member.

2. A labeler comprising:

a case having a carrier strip holder for holding a roll of carrier strip onto which a number of labels are stuck;

an actuating mechanism having an operating part extending into the case and pivotally mounted on said case and pivotable for movement within said case;

a carrier strip feeding mechanism housed in said case and engaging the carrier strip from the roll and driven by said operating part during movement thereof for feeding a fixed length of carrier strip when said carrier strip feeding mechanism is driven by said operating part;

a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member, said printing apparatus further comprising an ink applying device having a swing lever pivotally mounted on the case, an ink roller on the free end of said swing lever and movable across the printing means during the movement of said printing apparatus toward and away from said turnback member for applying ink to the printing means, said roller having an engaging groove around one end thereof, and a resilient guide member on said case resiliently engaged in said groove and curved along the path of movement of said roller on the end of said swing lever for holding said roller on said swing lever during movement of the swing lever and resiliently distortable out of said groove for freeing the ink roller from said swing lever for removal therefrom.

3. A labeler comprising:

a case having a carrier strip holder for holding a roll of carrier strip onto which a number of labels are stuck;

an actuating mechanism having an operating part extending into the case and pivotally mounted on said case and pivotable for movement within said case;

a carrier strip feeding mechanism housed in said case and engaging the carrier strip from the roll and driven by said operating part during movement thereof for feeding a fixed length of carrier strip when said carrier strip feeding mechanism is driven by said operating part;

a carrier strip turnback member in said case around the edge of which member the carrier strip is turned by the feeding action of said feeding mechanism for separating a label stuck on said carrier strip; and a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member;

said case having an opening in one side thereof, and said labeler further comprising a door for closing said opening and hinge means for mounting said door on said case, said hinge means comprising a shaft in said case extending perpendicular to the plane of the opening, a hinge body having the middle rotatably mounted on said shaft, said door being hingedly mounted on a free end of said hinge body, and said hinge body having a first spring means thereon engaged by said door when said door is in the closed position urging the door in the opening direction, and a second spring means engaged with said hinge body and resiliently acting on said hinge body for opposing rotational movement of said hinge body in either direction around said shaft.

4. A labeler as claimed in claim 3 in which said second spring means is an elongated resilient member extending from said hinge body, and holding means for holding the free end of said resilient member in a fixed position.

5. A labeler as claimed in claim 3 in which said case has a handle thereon having an extension extending into said case, and said holding means is on said extension.

6. A labeler as claimed in claim 3 further comprising a slide member adjacent said turnback member on the side thereof along which the carrier strip moves after the labels have been separated therefrom and with the path of the carrier tape between said turnback member and said slide member, and slide actuating means connected to said slide member and to said operating part for reciprocal sliding movement of said slide member toward and away from the edge of said turnback member for supporting the rear edge of a label which has been separated from the carrier strip.

7. A labeler comprising:

a case having a carrier strip holder for holding a roll of carrier strip onto which a number of labels are stuck;

an actuating mechanism having an operating part extending into the case and pivotally mounted on said case and pivotable for movement within said case;

a carrier strip feeding mechanism housed in said case and engaging the carrier strip from the roll and driven by said operating part during movement thereof for feeding a fixed length of carrier strip when said carrier strip feeding mechanism is driven by said operating part;

a carrier strip turnback member in said case around the edge of which member the carrier strip is turned by the feeding action of said feeding mechanism for separating a label stuck on said carrier strip; and a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member, said printing means having printing parts with faces for engagement with a label on said carrier strip extending over said turnback member, and said printing apparatus further having a holding frame having a frame plate on said one side thereof, a coupling part on said frame plate and a further coupling part on said operating part, and a fulcrum means by which said firstmentioned coupling part is engaged on said further coupling part, whereby said printing apparatus is mounted on said operating part for rocking movement for enabling adjustment of said printing means to the plane of the turnback member when said printing means is engaged with said turnback member for providing clear impressions by said printing means on the label.

8. A labeler as claimed in claim 7 in which said firstmentioned coupling part is a hollow cylindrical member extending parallel with the printing faces of said printing parts, said fulcrum member is a gripping fulcrum in said cylindrical member, and said further coupling part is a mounting shaft on said operating part extending into said hollow cylindrical member and gripped by said gripping fulcrum.

9. A labeler comprising:

a case having a carrier strip holder for holding a roll of carrier strip onto which a number of labels are stuck;

an actuating mechanism having an operating part extending into the case and pivotally mounted on said case for pivotal movement around an axis within said case;

a carrier strip feeding mechanism housed in said case and engaging the carrier strip from the roll and driven by said operating part during movement thereof for feeding a fixed length of carrier strip when said carrier strip feeding mechanism is driven by said operating part;

a carrier strip turnback member in said case around the edge of which member the carrier strip is turned by the feeding action of said feeding mechanism for separating a label stuck on said carrier strip, said carrier strip feeding mechanism having a feed drum driven by said operating part to rotate to drive the carrier strip, and further having a guide member having a center portion pivotally mounted in said case along the path of the carrier strip between said feed drum and said turnback member and having the opposite ends normally engaging the carrier strip for guiding the carrier strip around part of the periphery of the feed drum, said guide member having one end adjacent said feed drum movable toward and away from said drum during pivotal movement of said guide member to permit a carrier tape to be threaded around the drum when the labeler is being loaded with a carrier tape, said turnback member being positioned along the path of the carrier strip from said guide member for causing the other end of said guide member to be engaged by the tape normally extending from said drum to said turnback member to urge said one end of said guide member toward said drum; and a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member, said printing apparatus being mounted on said operating part for rocking movement about a point along an axis through said printing apparatus and parallel to the axis around which said operating part is pivotable for enabling adjustment of said printing means to the plane of the turnback member when said printing means is engaged with said turnback member for providing clear impressions by said printing means on the label.

10. A labeler comprising:

a case having a carrier strip holder for holding a roll of carrier strip onto which a number of labels are stuck;

an actuating mechanism having an operating part extending into the case and pivotally mounted on said case for pivotal movement around an axis within said case;

a carrier strip feeding mechanism housed in said case and engaging the carrier strip from the roll and driven by said operating part during movement thereof for feeding a fixed length of carrier strip when said carrier strip feeding mechanism is driven by said operating part;

a carrier strip turnback member in said case around the edge of which member the carrier strip is turned by the feeding action of said feeding mechanism for separating a label stuck on said carrier strip; and a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member, said printing apparatus being mounted on said operating part for rocking movement about a point along an axis through said printing apparatus and parallel to the axis around which said operating part is pivotable for enabling adjustment of said printing means to the plane of the turnback member when said printing means is engaged with said turnback member for providing clear impressions by said printing means on the label, said printing apparatus further having an ink applying device having a swing lever pivotally mounted on the case, an ink roller on the free end of the moving lever and movable across the printing means during the movement of said printing apparatus toward and away from said turnback member for applying ink to the printing means, said roller having an engaging groove around one end thereof, and a resilient guide member on said case resiliently engaged in said groove and curved along the path of movement of said roller on the end of said swing lever for holding said roller on said swing lever during movement of the swing lever and resiliently distortable out of said groove for freeing the ink roller from said swing lever for removal therefrom.

11. A labeler comprising:

a case having a carrier strip holder for holding a roll of carrier strip onto which a number of labels are stuck, said case having an opening in one side thereof, and further a door for closing said opening and hinge means for mounting said door on said case, said hinge means comprising a shaft in said case extending perpendicular to the plane of the opening in said case, a hinge body having its middle rotatably mounted on said shaft, said door being hingedly mounted on a free end of said hinge body, and said hinge body having a first spring means thereon engaged by said door when said door is in the closed position and urging the door in the opening direction, and a second spring means engaged by said hinge body and resiliently acting on said hinge body for opposing rotational movement of said hinge body in either direction around said shaft;

an actuating mechanism having an operating part extending into the case and pivotally mounted on said case for pivotal movement around an axis within said case;

a carrier strip feeding mechanism housed in said case and engaging the carrier strip from the roll and driven by said operating part during movement thereof for feeding a fixed length of carrier strip when said carrier strip feeding mechanism is driven by said operating part;

a carrier strip turnback member in said case around the edge of which member the carrier strip is turned by the feeding action of said feeding mechanism for separating a label stuck on said carrier strip; and a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member, said printing apparatus being mounted on said operating part for rocking movement about a point along an axis through said printing apparatus and parallel to the axis around which said operating part is pivotable for enabling adjustment of said printing means to the plane of the turnback member for providing clear impressions by said printing means on the label.

12. A labeler as claimed in claim 11 in which said second spring means is an elongated resilient member extending from said hinge body, and holding means for holding the free end of said resilient member in a fixed position.

13. A labeler as claimed in claim 12 in which said case has a handle thereon having an extension extending into said case, and said holding means is on said extension.

14. A labeler comprising:

a case having a carrier strip holder for holding a roll of carrier strip onto which a number of labels are stuck;

an actuating mechanism having an operating part extending into the case and pivotally mounted on said case for pivotal movement around an axis within said case;

a carrier strip feeding mechanism housed in said case and engaging the carrier strip from the roll driven by said operating part during movement thereof for feeding a fixed length of carrier strip when said carrier strip feeding mechanism is driven by said operating part;

a carrier strip turnback member in said case around the edge of which member the carrier strip is turned by the feeding action of said feeding mechanism for separating a label stuck on said carrier strip;

a slide member adjacent said turnback member on the side thereof along which the carrier strip moves after the labels have been separated therefrom and with the path of the carrier tape between said turnback member and said slide member, and slide actuating means connected to said slide member and to said operating part for reciprocal sliding movement of said slide member toward and away from the edge of said turnback member for supporting the rear edge of a label which has been separated from the carrier strip; and a printing apparatus having printing means thereon and having one side mounted on said operating part in said case and movable toward and into engagement with said turnback member by said operating part when said operating part is moved for engagement of said printing means with said turnback member to print a label which is carried on the carrier strip extending over said turnback member, said printing apparatus being mounted on said operating part for rocking movement about a point along an axis through said printing apparatus and parallel to the axis around which said operating part is pivotable for enabling adjustment of said printing means to the plane of the turnback member when said printing means is engaged with said turnback member for providing clear impressions by said printing means on the label.

* * * * *